US005355538A

United States Patent [19]

Fulford et al.

[11] Patent Number: 5,355,538

[45] Date of Patent: Oct. 18, 1994

[54] LIFTING AND TRANSPORTATION DEVICE FOR BED RIDDEN PATIENTS

[75] Inventors: Raymond Fulford, Winnipeg; Brian Prystupa; Steve Mardero, both of Manitoba, all of Canada

[73] Assignee: Canadian Aging & Rehabilitation Product Development Corporation, Winnipeg, Canada

[21] Appl. No.: 35,184

[22] Filed: Mar. 22, 1993

[51] Int. Cl.[5] ..... A61G 7/14; A61G 7/10

[52] U.S. Cl. ..... 5/86.1; 5/83.1; 5/81.1

[58] Field of Search ..... 5/81.1–89.1

[56] References Cited

U.S. PATENT DOCUMENTS

| | | | |
|---|---|---|---|
| 3,940,808 | 3/1976 | Petrini | 5/83.1 |
| 4,010,499 | 3/1977 | Davis et al. | 5/81.1 |
| 4,232,412 | 11/1980 | Petrini | 5/83.1 |
| 4,255,823 | 3/1981 | Boyer et al. | 5/81.1 |
| 4,387,473 | 6/1983 | Gettner | 5/81.1 |
| 4,712,257 | 12/1987 | James | 5/83.1 |
| 4,856,123 | 8/1989 | Henderson et al. | 5/81.1 |
| 4,890,853 | 1/1990 | Olson | 5/86.1 |

FOREIGN PATENT DOCUMENTS

| | | | |
|---|---|---|---|
| 2653009 | 4/1991 | France | 5/86.1 |
| 1053225 | 3/1966 | United Kingdom | 5/81.1 |

*Primary Examiner*—Alexander Grosz

*Attorney, Agent, or Firm*—Adrian D. Battison; Murray E. Thrift; Stanley G. Ade

[57] ABSTRACT

A device for lifting and transporting a patient from a bed includes a base frame with ground wheels for rolling across the ground. The frame includes two parallel horizontal rails with each rail having a main fixed center wheel and castor wheels at forward and rearward ends of the rail. A post mounted on the frame can move vertically and carries a push bar. A seat is mounted on the post on a U-shape frame with the seat including a base and a back rest portion. The base is pivotally mounted on one leg of the U-shape member and the back rest can pivot and slide relative to the other leg of the U-shape. The U-shape support is mounted on the post so as to swivel about a vertical axis with the vertical axis also translating relative to the post to move the center of gravity of the patient from an initial lifting position to a transport position.

21 Claims, 5 Drawing Sheets

LIFTING AND TRANSPORTATION DEVICE FOR BED RIDDEN PATIENTS

BACKGROUND OF THE INVENTION

This invention relates to a device for lifting and transporting bed ridden patients which is operable to move the patient from the lying position within the bed to a seated position in which the patient can be transported for toileting or transferring to a chair.

Many different devices have been proposed for transferring patients from the bed situation to a seating position for toileting or transfer to a chair and one example is shown in U.S. Pat. No. 4,856,123 of Henderson. In this device there is provided a base frame on which the device can roll across the floor with a single vertical post on which a patient support assembly can be raised and lowered. The patient support assembly includes a seat back portion and a seat bottom portion which are relatively hinged and moveable from a first horizontal position to an inclined seating position.

The device is somewhat difficult to push and maneuver due to the general configuration of the arrangement and due to the relatively large size necessary for the base to maintain stability of the patient over the base.

Presently available on the marketplace are also different designs of lifting device but in most cases these comprise effectively a crane arrangement with an overhead boom on which is suspended a sling of a fabric material. These arrangements are disadvantageous in that the patient is effectively suspended and hence feel insecure due to the relatively large amount of movement which can occur by pivotal action about the end of the boom. The use of the sling which is necessary for lifting a patient in this way can cause squeezing or compression of the patient as the fabric wraps around the patient and the forces are applied to the sides of the patient. This can be uncomfortable or painful for arthritic patients or patients with damaged bone structures. Furthermore the overhead boom and the pivotal action require a very large and widely spaced base frame to maintain stability. The large base significantly reduces maneuverability and hence the large base is difficult to enter limited areas and since it is difficult to rotate the large base due to the wide spacing of the wheels.

Other devices for transferring a patient from a lying position to its seated position comprise effectively collapsible wheelchairs but these have achieved little success in the marketplace due to their complexity and due to the fact that they require the patient to be rotated on the bed to a position transverse to the bed before the device can be moved into position. This type of movement is very difficult in comparison with the arrangement in which the patient is simply rolled side to side.

SUMMARY OF THE INVENTION

It is one object of the present invention, therefore to provide an improved patient lifting and transportation device for moving the patient from the lying position in bed to a seated position for toileting and the like.

According to the first aspect of the invention there is provided a lifting and transportation device for use by bed ridden patients comprising a base frame having a plurality of ground wheels on the base frame for rolling movement of the base frame across a floor;

an upstanding support structure extending upwardly from the base frame to be carried thereby and including a bottom portion mounted on the base frame and a top portion mounted on the bottom portion for movement upwardly and downwardly relative to the bottom portion for raising and lowering the patients;

a patient support assembly including a seat back portion for engaging the back of the patient and the seat bottom portion for engaging the buttocks and thighs of the patient, the seat back portion being pivotally connected to the seat bottom portion so as to be pivotal about a rear edge of the seat bottom portion from a first position, in which the seat back portion and the seat bottom portion lie in a common horizontal plane for supporting the patient in a lying position to a second position in which the seat back portion is inclined upwardly and rearwardly from the rear edge for supporting the patient in a sitting position; and, mounting means mounting the patient support assembly on the support structure for vertical movement therewith;

said mounting means including a rigid arm means extending outwardly from the support structure so as to hold the patient support assembly at a stable position over the base frame and means for rotating the patient support assembly about a vertical axis through 90° relative to the arm so as to rotate the patient relative to the base frame between the first position in which the patient lies transverse to the base frame and the second position in which the patient sits longitudinal of the base frame.

According to a second aspect of the invention there is provided a lifting and transportation device for use by bed ridden patients comprising a base frame having a plurality of ground wheels on the base frame for rolling movement of the base frame across a floor;

an upstanding support structure extending upwardly from the base frame to be carried thereby and including a bottom portion mounted on the base frame and a top portion mounted on the bottom portion for movement upwardly and downwardly relative to the bottom portion for raising and lowering the patients;

a patient support assembly including a seat back portion for engaging the back of the patient and the seat bottom portion for engaging the buttocks and thighs of the patient, the seat back portion being pivotally connected to the seat bottom portion so as to be pivotal about a rear edge of the seat bottom portion from a first position, in which the seat back portion and the seat bottom portion lie in a common horizontal plane for supporting the patient in a lying position to a second position in which the seat back portion is inclined upwardly and rearwardly from the rear edge for supporting the patient in a sitting position; and, mounting means mounting the patient support assembly on the support structure for vertical movement therewith; wherein the patient support assembly further comprises a side support, a pair of support arms projecting horizontally outwardly from the side support, the side support being mounted for pivotal movement about a horizontal axis between the support arms so as to raise and lower respective support arms, means mounting a forward part of the seat bottom for pivotal movement relative to one of the support arms about an axis longitudinal of the support arm, means mounting a rear surface of the seat back portion on the other of the support arms for pivotal and sliding movement relative thereto such that the rear edge of the seat bottom portion can move downwardly between the support arms to the second position.

According to a third aspect of the invention there is provided a lifting and transportation device for use by bed ridden patients comprising a base frame having a plurality of ground wheels on the base frame for rolling movement of the base frame across a floor;

an upstanding support structure extending upwardly from the base frame to be carried thereby and including a bottom portion mounted on the base frame and a top portion mounted on the bottom portion for movement upwardly and downwardly relative to the bottom portion for raising and lowering the patients;

a patient support assembly including a seat back portion for engaging the back of the patient and the seat bottom portion for engaging the buttocks and thighs of the patient, the seat back portion being pivotally connected to the seat bottom portion so as to be pivotal about a rear edge of the seat bottom portion from a first position, in which the seat back portion and the seat bottom portion lie in a common horizontal plane for supporting the patient in a lying position to a second position in which the seat back portion is inclined upwardly and rearwardly from the rear edge for supporting the patient in a sitting position; and, mounting means mounting the patient support assembly on the support structure for vertical movement therewith;

wherein the base frame is of a U shape in plan including a pair of side rails and a front rail, the support structure being arranged at the front rail and including a pushing bar extending generally parallel to the front rail against which an operator can push to move the device longitudinally of the side rails across the floor, the ground wheels including, on each side rail, a central wheel positioned partly along the side rail and mounted on an axle fixed transversely to the side rail and adjacent each end of the side rail a respective one of a pair of castor wheels.

One embodiment of the invention will now be described in conjunction with the accompanying drawings in which:

DESCRIPTION OF THE DRAWINGS

In the drawings like characters of reference indicate corresponding parts in the different figures.

DETAILED DESCRIPTION

Figure 1:
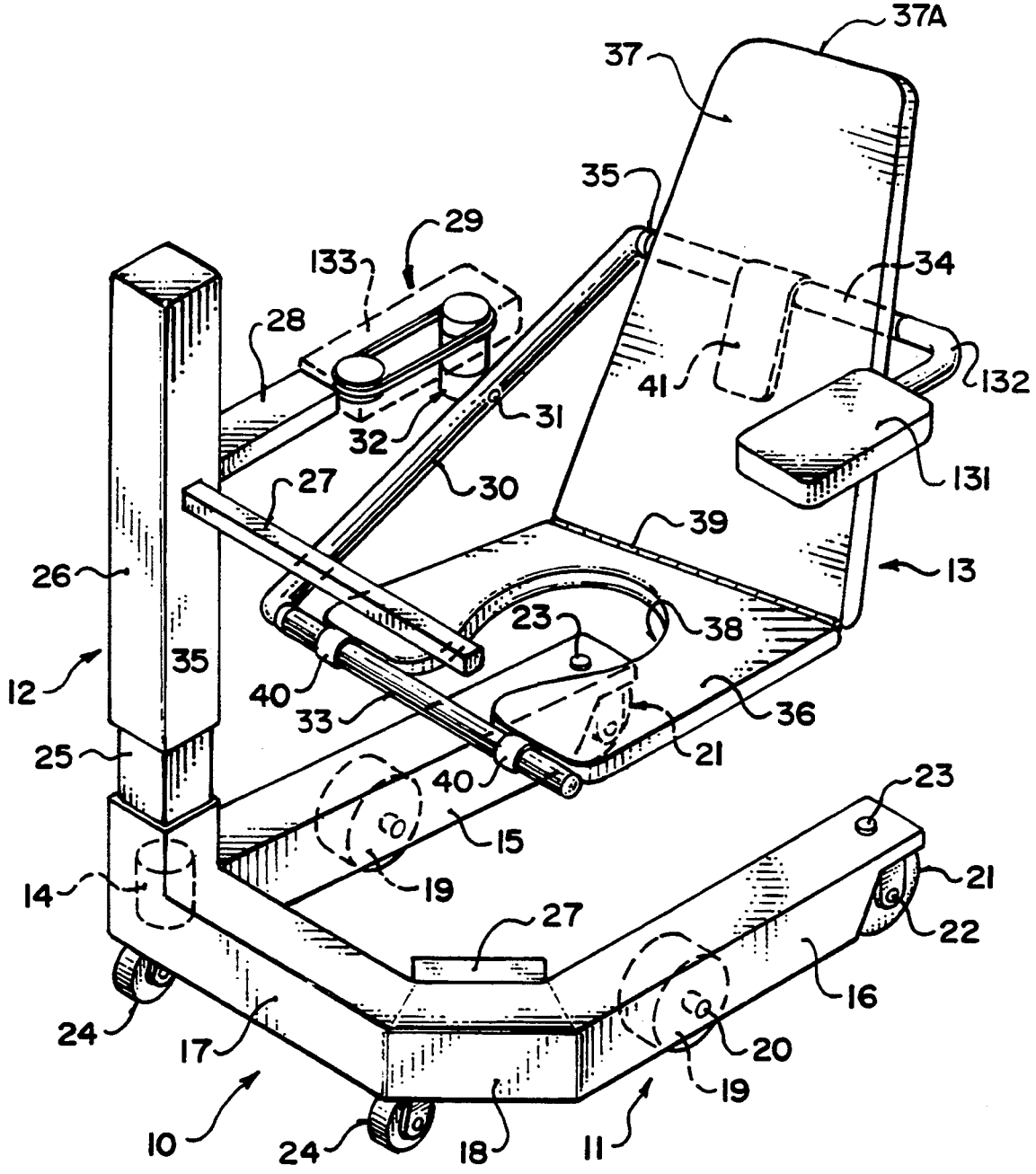
FIG. 1 is an isometric view of a patient lifting and transportation device according to the present invention.

The device for lifting and transporting the patient comprises a base frame 10 having a plurality of ground wheels generally indicated at 11 for movement of the base frame across the ground. At one corner of the base frame is provided an upstanding support structure 12 which carries the patient support assembly 13 movable to positions for lifting the patient and for transporting the patient. The device is shown in the transport position in FIGS. 1 and 2 and is shown in the lifting position in FIG. 3. The upstanding support structure 12 is movable by an actuator 14 upwardly and downwardly in a vertical direction to act for lifting and lowering the patient as required, The base frame 10 is generally U shaped in plan and includes three frame rails connected together and lying in a common horizontal plane, Two of the frame rails indicated at 15 and 16 are parallel and extend rearwardly from a front rail 17 which extends across a front edge of the base frame. In the embodiment shown the rail 17 is connected to the side rail 16 by an inclined rail piece 18 at 45° to each of the connecting rails. This arrangement slightly reduces the dimensions of the structure to make it more maneuverable. Each of the rails is formed from square tubing with the rails being welded together to provide integral rigid structure. The ground wheels generally indicated at 11 comprise two sets of wheels each set being mounted on a respective one of the side rails 15 and 16, Each set includes a central wheel 19 mounted on a fixed axle 20 which lies transverse to the length of the respective side rail. Thus the wheels 19 are fixed for movement longitudinal of the rails and do not rotate about a steering vertical axis. The wheels 19 are located at a position approximately midway along the length of the respective rail so as to provide the majority of the support for the rail. Thus the wheels 19 are positioned substantially directly underneath the centre of gravity of the patient when resting upon the patient support assembly.

At the rearward end of each rail is provided a first castor wheel 21 mounted for rotation about a transverse axle 22 and for castoring action about a vertical shaft 23. The wheels 21 are similar in size to the main wheels 19 since the majority of the support is provided by the wheels 19 and the wheels 21. Smaller castors 24 are provided at the forward end of each rail to prevent toppling of the structure in the event that weight is applied at a position forwardly of the axles 20 sufficient to tilt the structure about the axles 20.

This wheel structure allows ready maneuverability of the base frame since the majority of the weight is carried on the main wheels 19 which are positioned closely adjacent a centre of the base frame for rotation about a vertical axis of the base frame in maneuvering of the base frame for steering during forward movement or for twisting about its own centre. The front and rear castor wheels carry less weight but in addition are positioned as close as possible to the vertical central axis so that there is less torque required to rotate the base frame about the vertical central axis. The base frame can thus be readily pushed in a direction longitudinal of the side rail due to the fixed nature of the main wheels 19 and is little tendency for the device to twist left or right during the pushing action. However the device can also rotate about its own centre to provide the minimum turning radius.

The support structure 12 comprises a bottom post 25 mounted at the junction between the front rail 17 and the side rail 15 of the base frame. The support structure further includes a sleeve 26 slidable vertically on the post 25 with the provision of suitable bearing arrangements (not shown) of a conventional nature to allow the sliding action under load. The sliding action is effected by the actuator 14 which drives a screw (not shown)-carrying a nut connected to the sleeve 26. A battery pack 27 is mounted on the base frame at a suitable location and a manually operable switch is provided for operating the actuator 14. Preferably the switch is connected to a free cable which can be temporarily fastened to the sleeve 26 but is free to be carried around by the operator so that the operator can actuate the lifting action while moved away from the sleeve 26 to assist the patient.

The post formed by the sleeve 26 carries a pushing bar 27 connected to one side face of the post 26 and projecting outwardly therefrom across the top of the front rail 17 so that the operator can grasp the push bar 27 to apply force on the device longitudinal of the side rails.

The post 26 also carries a support arm 28 projecting rearwardly from the rear surface of the post parallel to and in the same vertical plane as the side rail 15. The arm 28 carries a link 29 which in turn is connected to and carries the patient support assembly 13.

The patient support assembly 13 comprises a main side support 30 in the form of an elongate tubular beam. The beam 30 is pivotal about a horizontal axle 31 mounted on a collar 32 forming a part of the link 29. The collar 32 as explained hereinafter allows rotation of the beam 30 about a vertical axis and the control of the link 29 while the shaft 31 connected to the collar 32 allows substantially free movement of the beam about the horizontal axis of the shaft.

At each end of the beam 30 is mounted a support arm 33, 34 which projects horizontally outwardly therefrom in a direction parallel to the axis of the shaft 31. The shaft 31 is positioned approximately midway between the arms 33 and 34 so that the arms are raised and lowered by the pivotal action of the beam about the shaft 31. Each of the arms 33 and 34 is connected to the beam 30 by a quick release coupling 35 allowing the arms to be removed. This allows the seat portion of the patient support assembly to be removed for example when the patient is seated in a chair and also allows the seat portion to be replaced by a different structure should this be required for other types of moving of the patient.

The preferred form of the seat structure is illustrated and comprises a seat bottom portion 36 and a seatback portion 37. Each of these portions is in the form of a rigid plate so that the upper surface of the seat bottom portion can receive the buttocks and thighs of the patient and the seat back portion can receive the back of the patient resting against the front surface of the seat back portion. If desired the seat bottom portion 36 can include an opening 38 for toileting. If used for transferring the patient to a chair, the seat bottom portion may be formed in a manner which allows it be removed from the chair after the patient is seated. Thus the seat bottom portion may be formed of side rails and fabric for ready removal from the chair. The rigid seat back portion can be removed from the chair simply by causing the patient to lean slightly forwardly and then pull the back portion outwardly when disconnected from the seat bottom portion.

The seat bottom portion 36 is connected to the seat back portion 37 by a piano hinge 39 across the adjacent edges of those portions. The hinge 39 is unsupported and hence it is free to move downwardly under the weight of the patient. The front edge of the seat bottom portion 36 is connected to the support arm 33 by suitable straps 40 which allow pivotal action of the seat bottom portion about the axis of the arm 33. The seat back portion is connected to the arm 34 by a link plate 41 having a hook portion 42 at its upper end. The link plate is fastened to the rear surface of the seat back portion and provides a slide guide allowing the arm 34 to slide relative to the undersurface of the seat back portion up to a position in which the arm 34 engages into the loop 42 at the upper end of the plate 41.

Figure 4:
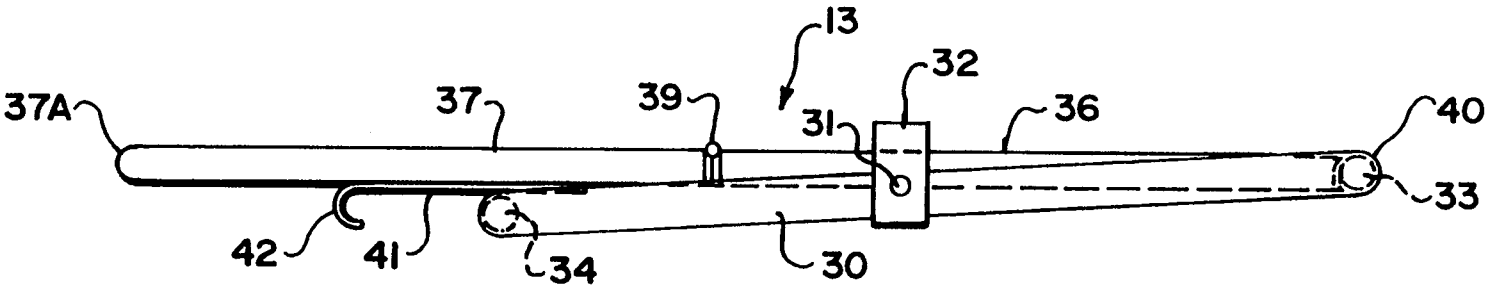
FIG. 4 is view along the lines 4—4 of FIG. 3 showing only the patient support assembly.
Figure 5:
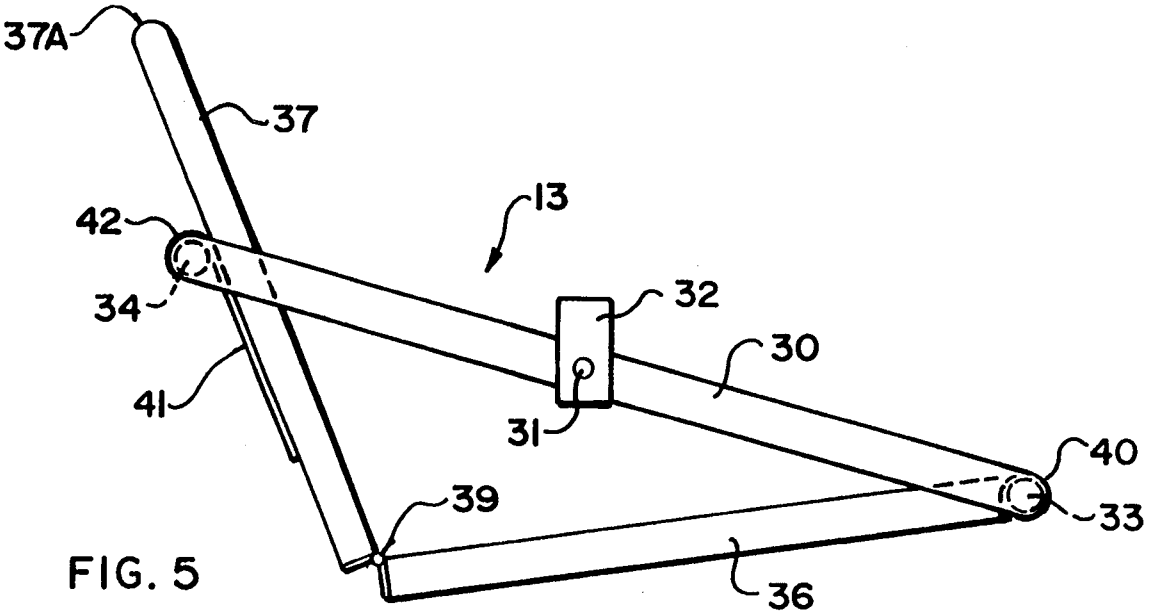
FIG. 5 is a view along the lines 5—5 of FIG. 2 showing again only the patient support assembly.

As will be apparent from a comparison of the position shown in FIGS. 4 and 5, the patient support assembly can take up a first position in which the seat bottom portion 36 and the seat back portion 37 lie in a common horizontal plane. In this position the beam 30 is pivoted in a counter clockwise direction so that it is approximately horizontal but with the arm 33 raised slightly above the arm 34. The seat portions then extend across from the arm 33 supporting one end over the arm 34 to the upper end 37A of the seat back portion which projects outwardly beyond the arm 34. In this position the patient can be supported on the patient support assembly lying in horizontal position. The patient can be moved to the seating position shown in FIG. 5 simply by the free pivotal movement of the beam 30 about the axle 31 which allows the arm 33 to fall relative to the arm 34 and the hinge 39 similarly to fall with the plate 41 sliding on the arm 34 until the loop 42 engages the arm 34 and halts further movement in the position shown in FIG. 5. In this position the seat back portion is inclined upwardly and rearwardly to receive the back of the patient resting there against. The seat bottom portion is inclined slightly downwardly to the hinge line in a position of comfortable seating. An arm rest 131 for the patient mounted as a coupling arm is connected to the outer end of the support arm 34. A second arm rest 133 can be provided over the pivotal link 29 when the patient support assembly is in the second position.

Figure 2:
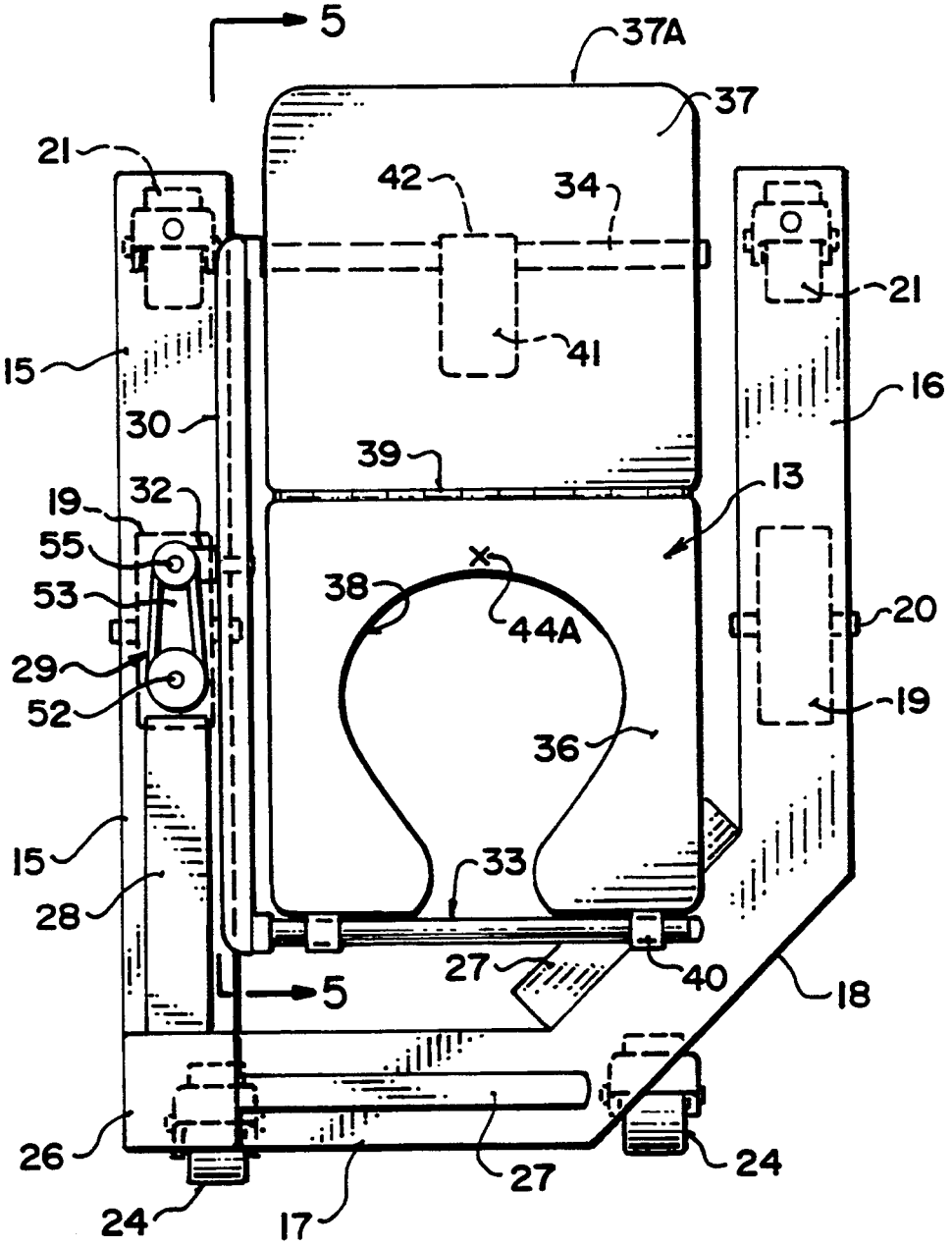
FIG. 2 is a top plan view of the device of FIG. 1 shown in the position of FIG. 1.
Figure 3:
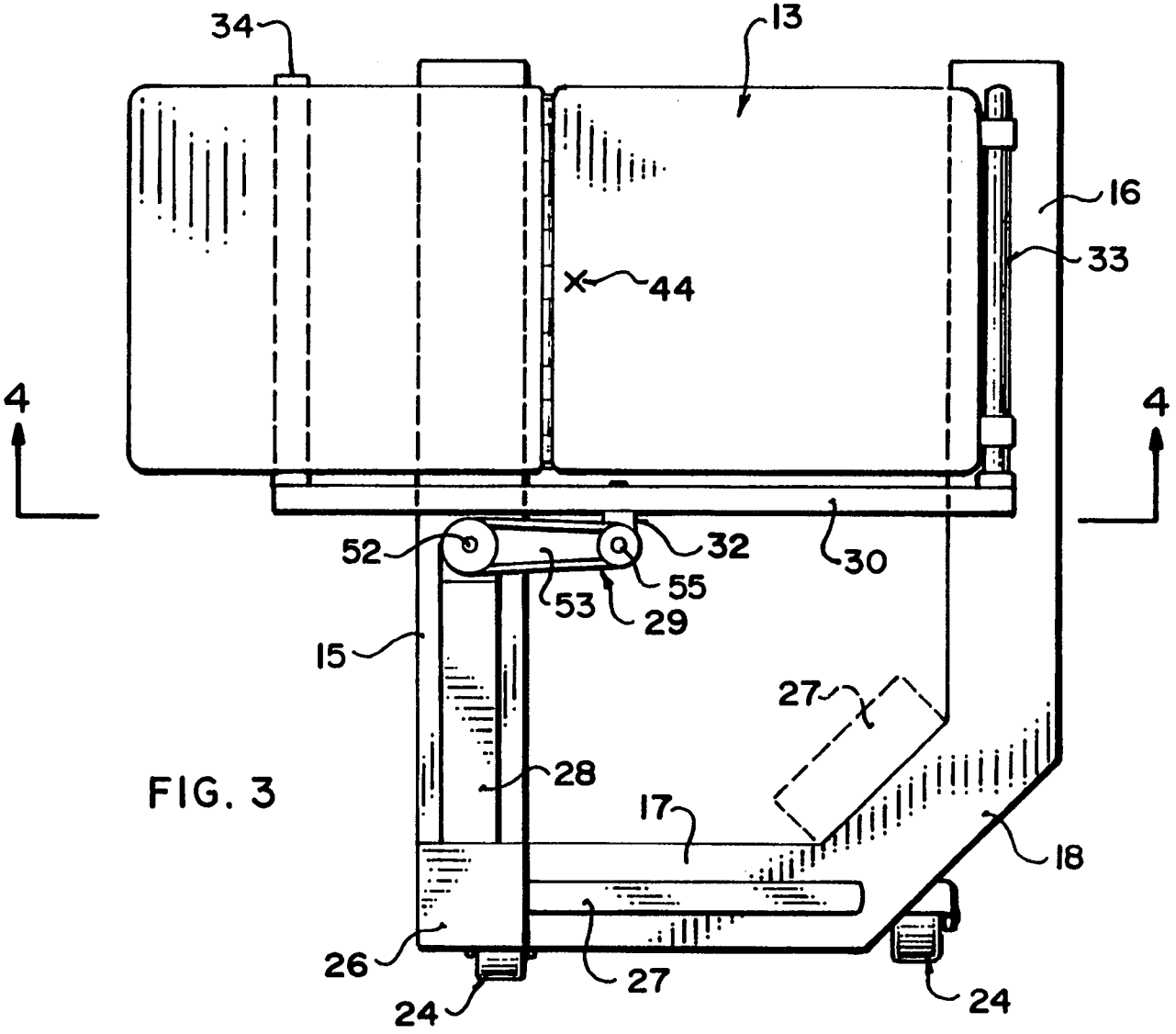
FIG. 3 is a top plan view of the device of FIG. 1 shown in a modified position for lifting the patient.

In addition to the simple pivoting movement of the beam 30 allowing the movement from the lying to the sitting position, the patient support assembly is also pivotal under control of the link 29 from the position shown in FIG. 2 to the position shown in FIG. 3 and vice versa. The lying position is shown in FIG. 3 and in this position the beam 30 is rotated about an axle or pivot means 55 so that it lies transverse to the side rails 15 and 16. In a position shown in FIG. 2, the beam 30 is rotated about the pivot means 55 through 90° so that the patient in the sitting position is arranged longitudinally of the side rails 15 and 16. At the same time the link 29 pivots about an axle 52 from the position shown in FIG. 3 in which it lies at right angles to the arm 28 to the position shown in FIG. 2 in which it is parallel to the arm 28 and extends outwardly therefrom along the side rail 15. This movement causes horizontal translation of the pivot means 55 which effects the movement of the centre of gravity of the patient in a translation action across the base frame so that the centre of gravity is kept as far as possible within the base frame thus allowing the base frame to be formed of minimum dimensions. More specifically in the lying position shown in FIG. 3, the centre of gravity 44 of the patient is moved by the pivotal movement of the link 29 toward the right so as to bring that centre of gravity toward the right of the side rail 15 to provide improved stability. At the same time the centre of gravity is moved toward the front rail 17 again improving stability. In a position shown in FIG. 2, the centre of gravity indicated at 44A is moved to a position midway between the side rails 15 and 16 to provide the best stability for transport. At the same time the center of gravity is moved slightly rearwardly so as to maintain centre gravity as far as possible over the wheels 19. In the position shown in FIG. 2, the seat is located substantially symmetrically between the rails 15 and 16.

In operation, with the patient lying in a bed, the device is moved so that the side rails 15 and 16 lie at right angles to the side of the bed bringing the side edge of the patient support assembly directly parallel to the side of the bed. With the patient then rolled away from the device, the device can be moved over the upper surface of the bed so that the side edge lies over the bed. As shown in FIG. 4, the device is of minimum height allowing it to lie substantially flat on the bed. The patient is then rolled back onto the device and the device lifted by operation of the actuator 14 until the patient drops into the seating position shown in FIG. 5 by the normal operation of the center of gravity of the patient which tends to push down on the hinge line 39. When the patient is lifted free of the bed, the device can be rotated from the position shown in FIG. 3 into a position shown in FIG. 2. The device can then be pulled away from the bed carrying the patient with the device. When in the seating position, the patient can be transported by the operator pushing on the push bar 27 to move the patient to a different room for activities such as toileting and seating.

Figure 6:
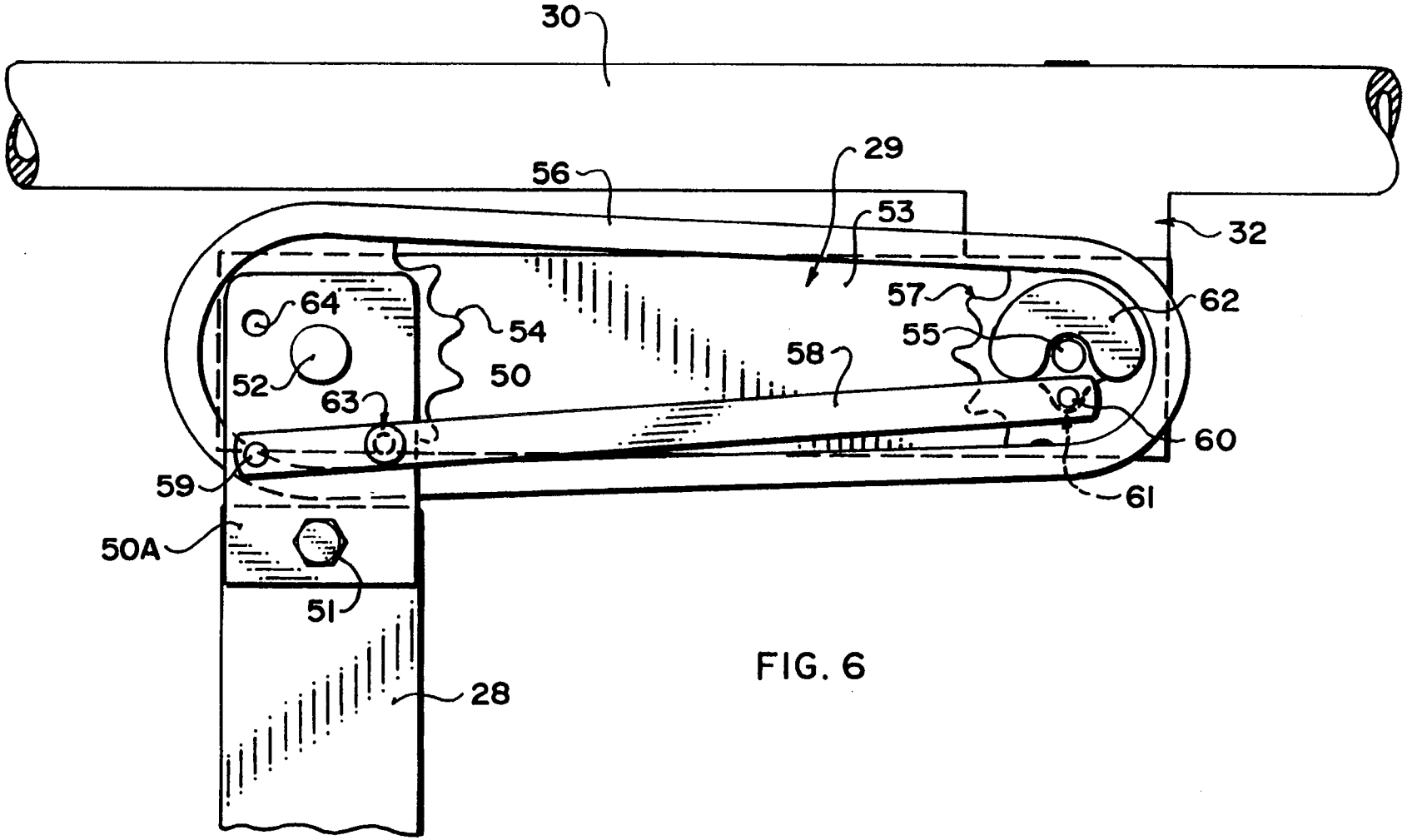
FIG. 6 is a top plan view on an enlarged scale of the support link for the patient support assembly.

The link 29 is shown in more detail in FIG. 6. This comprises a fixed support 50 which is bolted to the arm 28 by a suitable bolt connection 51. The fixed support comprises a pair of plates including a top plate 50A which is shown and a bottom plate (not visible) spaced from the top plate. Between the plates is connected the axle 52 which is vertical and which carries a plate 53 for pivotal movement about the axle 52. At the opposite end of the plate 53 is provided the second axle or pivot means 55 which carries the collar 32 connected to the beam 30. Thus the double pivot action about the vertical axis of the axle 52 and the vertical axis of the axle 55 allows the movement described previously of the link 29. This movement is however controlled by a sprocket 54, a chain 56 and a second sprocket 57. The sprocket 54 is mounted on the axle 52. The sprocket 57 is mounted on the axle 55 and has half as many sprocket teeth as the sprocket 54. The sprocket 54 is connected to the mounting plate 50. The sprocket 57 is connected to the collar 32. As the plate 53 thus rotates through 90° about the axle 52, the chain drives 56 the sprocket 57 and the collar 32 to rotate through 180° due to the number of teeth on the sprockets. A brief comparison of the positions shown in FIGS. 2 and 3 will show that these angles are the required angles for taking up the positions as shown.

The movement of the plate 53 of the link 29 about the axle 52 is controlled by a locking mechanism so that it is stably locked at each extreme position. Many such locking arrangements will be apparent to one skilled in the art but in one example there is provided (as shown) a link bar 58 pivotally mounted at one end on a pin 59 carried on the plate 50. At its opposed end the link bar 58 carries a locking pin 60 which engages into a locking recess 61 provided on the sprocket 57. A cam 62 provided also on the sprocket 57 forces the link bar 58 in a clockwise direction so the pin 60 engages into the recess 61 and prevents movement of the sprocket beyond the position shown in FIG. 6, The link bar is then latched by a latch pin 63 of the spring mounted type which engages through the link bar into an opening in the plate 50A. Thus the link bar locks the plate 53 and the whole link 29 in the position shown in FIG. 6 to prevent inadvertent twisting of the patient support assembly. The locked position can be released by pulling the pin 63 to release the link bar 58. This allows the plate 53 to pivot about the axle 52 to begin to move in the counterclockwise direction toward the position shown in FIG. 2. As this movement occurs, the chain is moved around the sprocket 54 and thus drives the sprocket 57 to cause the required angle of movement of the collar 32 about the axle 55. At the second position shown in FIG. 2, the link bar 58 is again forced by the cam 62 to engage into the recess 61. This link bar thus takes up any excess energy in the movement to prevent rapid acceleration or deceleration of the patient support assembly and also acts to lock the system in the two required positions. In the second position, the pin 63 engages into an opening 64 in the mounting plate 50.

The device therefore provides a stable structure which allows the patient to be lifted from the bed and then rotated into position symmetrically between the side rails for transportation. The U shaped frame allows the base frame to enter under the bed for initial lifting operation and allows the frame to pass over or around a toilet bowl for toileting while the patient is in the sitting position shown in FIG. 2. The base frame is of substantially minimum dimension which is achieved by the movement of the centre of gravity by the patient. This allows ready maneuverability of the base frame and the patient over the wheels as previously described.

In some cases it may be necessary to reverse the arrangement of the device so that the patient support assembly is turned through 180° for lifting the patient from the opposed side, This may be caused by the configuration of the room which the bed is located or in some cases the patient may require lifting from only side due to injury or illness. This can be achieved by various techniques including replacement of the patient support assembly with a patient support assembly which is symmetrically opposed. In some cases the upright support structure including the post 26 may be removed to the opposite side onto a subsidiary post portion on the base frame.

The rigid seat support panels as previously described are suitable particularly for toileting but may be disadvantageous in transferring the patient to a chair. Once in the chair it is generally necessary to remove the seat back and also to remove the seat bottom so that the patient is then properly seated in the chair. This can be achieved in some cases by a clam shell arrangement in which the patient support assembly when removed by disconnecting the coupling 35 can be pulled to respective sides of the patient with a split in the structure along the back of the patient. This arrangement is similar to the known arrangement of clam shell type stretchers which can be engaged under a patient without lifting the patient. In other cases the seat bottom can be formed from fabric supported by a rigid front arm and by a pair of side arms which can disconnect from the seat back. The seat back can then be pulled out from under the patient. The seat bottom, being generally flexible, can remain in place until the patient is required to be returned to the bed.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A lifting and transportation device for use by a bed ridden patient comprising a base frame having a plurality of ground wheels on the base frame for rolling movement of the base frame across a floor;

an upstanding support structure extending upwardly from the base frame to be carried thereby and including a bottom portion mounted on the base frame and a top portion mounted on the bottom portion for movement upwardly and downwardly relative to the bottom portion for raising and lowering the patient;

a patient support assembly including a seat back portion for engaging the back of the patient and the seat bottom portion for engaging the buttocks and thighs of the patient, the seat back portion being pivotally connected to the seat bottom portion so as to be pivotal about a rear edge of the seat bottom portion from a first position, in which the seat back portion and the seat bottom portion lie in a common horizontal plane for supporting the patient in a lying position to a second position in which the seat back portion is inclined upwardly and rearwardly from the rear edge for supporting the patient in a sitting position; and, mounting means mounting the patient support assembly on the support structure for vertical movement therewith;

said mounting means including a rigid arm means extending outwardly from the support structure so as to hold the patient support assembly at a stable position over the base frame, pivot means for rotating the patient support assembly about a vertical axis through 90° relative to the arm so as to rotate the patient support assembly relative to the base frame between the first position in which the patient lies transverse to the base frame and the second position in which the patient sits longitudinal of the base frame and translation means for horizontally translating the pivot means relative to the support structure so that, as the patient support assembly is rotated from the first position to the second position, the pivot means is also moved horizontally to move the center of gravity of the patient relative to the base frame.

2. The device according to claim 1 including means interconnecting the translation means and the pivot means for simultaneous actuation such that the center of gravity is moved simultaneously with the rotation of the patient support assembly.

3. The device according to claim 1 wherein the translation means is arranged such that the pivot means is moved so that, as the patient support assembly is moved to the first position with the patient lying transverse to the frame, the pivot means is moved toward a front of the frame and so that, as the patient support assembly is moved to the second position the pivot means is moved rearwardly of the front of the frame and toward one side of the frame.

4. The device according to claim 3 wherein the base frame is U shaped with a transverse rail at the front of the frame and a pair of side rails extending rearwardly from the front transverse rail.

5. The device according to claim 3 wherein the translation means includes a pivotal link pivotally mounted at one end to a fixed position on the support structure for pivotal movement about a first vertical axis with the pivot means connecting an opposed end of the pivotal link to the patient support assembly for pivotal movement of the patient support assembly relative to the pivotal link about a second vertical axis parallel to the first, the pivotal link being arranged to rotate about the first axis through 90° while the patient support assembly rotates through 90° relative to the support structure.

6. The device according to claim 5 wherein the pivotal link includes a pair of sprockets and drive chain, the size of the sprockets being arranged such that, as the pivotal link pivots about the first axis through 90° the patient support assembly rotates through 180° relative to the pivotal link.

7. The device according to claim 5 including an arm rest structure mounted over the pivotal link on which an arm of the patient can rest when the patient support assembly is in the second position.

8. The device according to claim 1 wherein the support structure comprises a single post upstanding from the base frame.

9. The device according to claim 8 including a push bar extending from the post transversely of the frame by which an operator can push the device and the patient longitudinally of the frame.

10. The device according to claim 1 wherein the patient support assembly further comprises a side support bar, a pair of support arms projecting horizontally outwardly from the side support bar, said mounting means being connected to the side support bar at a position thereon between the support arms for pivotal movement of the side support bar about a horizontal axis defined by the mounting means between the support arms so as to raise and lower respective support arms, means mounting a forward part of the seat bottom portion for pivotal movement relative to one of the support arms about an axis longitudinal of the support arm, means mounting a rear surface of the seat back portion on the other of the support arms for pivotal movement relative to the other of the support arms about an axis longitudinal of the other support arm, and means allowing sliding movement of one of the seat bottom portion and the seat back portion relative to the respective support arm such that the rear edge of the seat bottom portion can move downwardly between the support arms to the second position.

11. The device according to claim 10 including an arm rest member mounted on the other of the support arms and extending outwardly therefrom beyond a side edge of the seat back portion remote from the side support bar.

12. The device according to claim 10 wherein the seat back portion and the seat bottom portion are both formed of rigid panels.

13. The device according to claim 10 including means for removing the seat back portion and the seat bottom portion from the side support bar.

14. The device according to claim 10 wherein the means mounting the rear surface of the seat back portion on the other of the support arms comprises a slide plate and a hook member at one end of the slide plate, the hook member preventing sliding movement of the seat back portion beyond the second position.

15. The device according to claim wherein the base frame is of a U shape in plan including a pair of side rails and a front rail, the support structure being arranged at the front rail and including a pushing bar extending generally parallel to the front rail against which an operator can push to move the device longitudinally of the side rails across the floor, the ground wheels including, on each side rail, a central wheel positioned partly along the side rail and mounted on an axle fixed transversely to the side rail and adjacent each end of the side rail a respective one of a pair of castor wheels.

16. A lifting and transportation device for use by a bed ridden patient comprising a base frame having a plurality of ground wheels on the base frame for rolling movement of the base frame across a floor;

an upstanding support structure extending upwardly from the base frame to be carried thereby and including a bottom portion mounted on the base frame and a top portion mounted on the bottom portion for movement upwardly and downwardly relative to the bottom portion for raising and lowering the patient;

a patient support assembly including a seat back portion for engaging the back of the patient and the seat bottom portion for engaging the buttocks and thighs of the patient, the seat back portion being pivotally connected to the seat bottom portion so as to be pivotal about a rear edge of the seat bottom portion from a first position, in which the seat back portion and the seat bottom portion lie in a common horizontal plane for supporting the patient in a lying position to a second position in which the seat back portion is inclined upwardly and rearwardly from the rear edge for supporting the patient in a sitting position; and, mounting means mounting the patient support assembly on the support structure for vertical movement therewith; wherein the patient support assembly further comprises a rigid side support bar, a pair of support arms projecting horizontally outwardly from the side support bar, said mounting means being connected to the side support bar at a position thereon between the support arms for pivotal movement of the side support bar about a horizontal axis defined by the mounting means between the support arms so as to raise and lower respective support arms, means mounting a forward part of the seat bottom portion for pivotal movement relative to one of the support arms about an axis longitudinal of the support arm, means mounting a rear surface of the seat back portion on the other of the support arms for pivotal movement relative to the other of the support arms about an axis longitudinal of the other support arm, and means allowing sliding movement of one of the seat bottom portion and the seat back portion relative to the respective support arm such that the rear edge of the seat bottom portion can move downwardly between the support arms to the second position.

17. The device according to claim 16 including an arm rest member mounted on the other of the support arms and extending outwardly therefrom beyond a side edge of the seat back portion remote from the side support bar.

18. The device according to claim 16 wherein the seat back portion and the seat bottom portion are both formed of rigid panels.

19. The device according to claim 16 including means for removing the seat back portion and the seat bottom portion from the side support bar.

20. The device according to claim 16 wherein the means mounting the rear surface of the seat back portion on the other of the support arms comprises a slide plate and a hook member at one end of the slide plate, the hook member preventing sliding movement of the seat back portion beyond the second position.

21. A lifting and transportation device for use by a bed ridden patient comprising a base frame having a plurality of ground wheels on the base frame for rolling movement of the base frame across a floor;

an upstanding support structure extending upwardly from the base frame to be carried thereby and including a bottom portion mounted on the base frame and a top portion mounted on the bottom portion for movement upwardly and downwardly relative to the bottom portion for raising and lowering the patient;

a patient support assembly including a seat back portion for engaging the back of the patient and the seat bottom portion for engaging the buttocks and thighs of the patient, the seat back portion being pivotally connected to the seat bottom portion so as to be pivotal about a rear edge of the seat bottom portion from a first position, in which the seat back portion and the seat bottom portion lie in a common horizontal plane for supporting the patient in a lying position to a second position in which the seat back portion is inclined upwardly and rearwardly from the rear edge for supporting the patient in a sitting position; and, mounting means mounting the patient support assembly on the support structure for vertical movement therewith;

wherein the base frame is of a U shape in plan including a pair of side rails and a front rail, the support structure being arranged at the front rail and including a pushing bar extending generally parallel to the front rail against which an operator can push to move the device longitudinally of the side rails across the floor, the ground wheels including, on each side rail, a central wheel positioned substantially midway along the side rail and mounted on an axle fixed transversely to the side rail and adjacent each end of the side rail a respective one of a pair of castor wheels.

* * * * *